United States Patent [19]

Blauert et al.

[11] 3,962,543

[45] June 8, 1976

[54] METHOD AND ARRANGEMENT FOR CONTROLLING ACOUSTICAL OUTPUT OF EARPHONES IN RESPONSE TO ROTATION OF LISTENER'S HEAD

[75] Inventors: Jens Blauert, Aachen-Laurensberg; Georg Boerger, Berlin; Peter Laws, Aachen, all of Germany

[73] Assignee: Eugen Beyer Elektrotechnische Fabrik, Heilbronn, Germany

[22] Filed: May 15, 1974

[21] Appl. No.: 470,015

[30] Foreign Application Priority Data

June 22, 1973 Germany ..... 23316196

[52] U.S. Cl. ..... 179/1 G

[51] Int. Cl.[2] ..... H04R 5/00

[58] Field of Search ..... 179/1 G, 1 GP, 100.4 ST, 179/100.1 TD, 156, 1 J, 1 AT, 1 R

[56] References Cited

UNITED STATES PATENTS

| | | | |
|---|---|---|---|
| 3,088,997 | 5/1963 | Bauer | 179/1 G |
| 3,236,949 | 2/1966 | Atal et al. | 179/1 G |
| 3,504,120 | 3/1970 | Levitt | 179/1 G |
| 3,683,130 | 8/1972 | Kahn | 179/156 R |

*Primary Examiner*—Kathleen H. Claffy
*Assistant Examiner*—George G. Stellar
*Attorney, Agent, or Firm*—Michael J. Striker

[57] ABSTRACT

Sound signals are created at the eardrums of a listener to correspond to sound signals which would be created at the eardrums of the listener in a predetermined acoustical environment in response to first electrical signals applied to a loudspeaker having known sound-reproducing characteristics. A determination of the relative position of the head of the listener when the listener is in the predetermined acoustical environment is made, producing a second signal. An equalizing network is provided with a first input for receiving said first electrical signals, and a second input for receiving the second signals, and a pair of outputs connected to the earphones on the headset of a listener.

21 Claims, 15 Drawing Figures

$U_L(f)$
$\frac{A_L(f,\varphi,R)}{A_K(f)}$
$\frac{A_r(f,\varphi,R)}{A_K(f)}$
$EN_L$
$EN_r$
$A_L(f,\varphi,R)$
$A_r(f,\varphi,R$
BE
ME
K
$\varphi$
VP
KB
HG
K
$X_L(\varphi)$
$X_r(\varphi)$
GS

METHOD AND ARRANGEMENT FOR CONTROLLING ACOUSTICAL OUTPUT OF EARPHONES IN RESPONSE TO ROTATION OF LISTENER'S HEAD

BACKGROUND OF THE INVENTION

The invention relates to a method and arrangement for eliminating or reducing the sound reproduction effect in head-phones due to the turning of one's head. The invention relates more particularly to specific head-phones with sound-reproducing characteristics normally associated only with large speakers spaced a distance from the listener. Such head-phones simulate the spaciousness of the sound reproduced by a larger speaker, and particularly that produced by a plurality of speakers spaced apart from one another, in a head-phone set.

Head-phones are used nowadays in ever greater numbers, such as for listening to radio broadcasts, phonograph records, and tape recordings. Furthermore head-phones are used for technical audio purposes, such as for monitoring purposes during recording sessions, live broadcasting and so-called play-back techniques.

One of the chief reasons for the increasing popularity of head-phones for home use is that they permit the listener to hear live broadcast or recorded material without disturbing other persons not wishing to listen, and likewise prevents the listener from being distracted by other sources of sound in the room in which he is present. However, there are significant disadvantages associated with the use of head-phones, as opposed to ordinary loud speakers. Head-phones, even those of high quality, exhibit sound reproducing characteristics which are very different from those of loudspeakers. These different sound reproducing characteristics include not only difference in frequency response, but equally important differences in the sense of acoustical spaciousness and direction of sound experienced by the listener.

When a head-phone set is plugged into the same electrical outputs into which are plugged the inputs of a loudspeaker system, very marked differences are observed in the acoustical effects received by the listener from using the earphones of the headset, instead of the loudspeaker. Aside from minor differences in frequency response, there are differences of a psychological nature, relating to the spatial characteristics of the received sound. For example, the listener often perceives that the orchestra is located within the head of the listener or at a distance from the listener's head on the order of magnitude of the distance between the listener's ears, rather than at a remote location from the listener. This is particularly true when the listener is listening to loud music, which is frequently the case when listening to high-quality stereophonic equipment.

It has been extremely difficult to deal in a systematic and scientific manner with these psychological phenomena. The causes of these phenomena have always been assumed to include such factors as unavoidable differences in the sound-producing characteristics of the head-phone sets, the exact positioning of the earpieces of the head-phones, with respect to the listener's ears, the pressure with which the earpieces press against the listener's ears, the sound transmissivity of the skull bone of the particular listener, the effect of the listener of moving his head while listening and other such physiological and psychological factors. In listening to head-phones, the electro-acoustical transduction phenomena does not include the factor of substantial transmission distance, sound dampening, sound distribution within the room between the listener and speaker, and the combination of sound before the sound reaches the listener's ear; instead, the total electro-acoustical transduction depends directly on the tranducer characteristics of the earphones in the headset rather than the external environment of the listener. There have been a number of methods directed at eliminating both the spatial and spectral distortion associated with the use of head-phone set, i.e., as specifically compared to the spatial and spectral phenomena associated with high-quality loudspeakers employed to listen to the same material.

German Offenlegungsschrift, No. 1,927,401 discloses one such attempt to deal with the problem. According to the approach in question, experiments were conducted on an artificially constructed human head provided with two microphones in the region of the ears of the head. The acoustical characteristics of an actual human head were simulated to the greatest extent possible, and measurements were taken of the sound reception in the ear canals' locations of such head. As a result of the measurements taken, recording engineers were able to modify their recording technique in such a manner as to produce recordings or broadcasts which, when listened to with earphones, will have the desired improved spatial and spectral characteristics. This approach is, however, of little practical value. It would necessitate the establishment of an entirely new category of recording equipment and broadcasting channels which would be used with earphone reception specifically in mind. This is evidently undesirable because it would entail the manufacture of duplicate records and tapes, and the transmissions of broadcasts falling into one category or another, with the listener being compelled to listen to the selected one, or else settling for a considerable amount of distortion.

Another method for imparting to head-phones the sound-reproducing characteristics of loudspeakers is set forth in U.S. Pat. application Ser. No. 395,371 now U.S. Pat. No. 3,920,904. This method entails furnishing an electrical network having a network transfer function corresponding to a predetermined function of both the desired transfer function and the earphone transfer function.

SUMMARY OF THE INVENTION

It is an object of the invention to provide a method and arrangement for controlling acoustical output of earphones.

It is another object of the invention to provide an arrangement for determining the relative position of a listener's head in a predetermined environment.

It is another object of the invention to convert the movements of a person's head into signals that control the acoustical output of earphones.

The invention is directed at simulating the difference acoustical effects heard in each individual ear of a listener as he moves his head in a predetermined acoustical environment. As a listener turns his head, his two ears will automatically be able to determine the source of the sound, on the basis of auditory characteristics or cues such as volume and tone. It is the intention of the present invention to simulate these auditory cues in each individual earphone of a headset, which is coupled with an arrangement to determine the relative positions of the listener's head in the predetermined acoustical environment.

The present invention is therefore implemented by continuously changing the mon-aural and bi-aural electro-acoustical transfer factors associated with a loudspeaker system situated at a predetermined distance and direction from the listener. In this connection one can speak of the characteristic acoustical perceptions of the acoustic environment.

The invention therefore provides a means for determining the movement of the head with reference to an imaginary loudspeaker situated in the room, and a means for translating this information into electrical signals to modify the acoustics of the earphones of the listener. This implementation is achieved by either a mechanical, electrical or magnetic control arrangement which can determine the relative motions of the listner's head with respect to a predetermined initial position. This information can then be translated into electrical signals for modification of the electro-acoustical transfer function network. Thus the motion of the head will be immediately translated into electrical signals, which in turn, will change the acoustical effects heard in the earphones by the listener. The result of this method and arrangement would give the listener the sensation of listening to a loudspeaker at a predetermined distance from his head. The auditory clues which the listener receives from the earphones would serve to simulate the effects of a remotely located loudspeaker.

Some specific embodiments of the mechanical, electrical, or magnetic control mechanisms for determining the relative positions of the head are torsion arrangements and gyroscopes. Such arrangements may preferably be mounted on top of the head of the listener, passing through an axis through a midway or midpoint of the listener's head. The exact angle of rotation of the listener's head will thereby be correctly translated into an electrical or mechanical signal. For example, the rotation of the head may result in a mechanical displacement, generation of stress or strain, or similar effects. These mechanical effects may then be translated into electrical signals by means of transducers. It is equally possible to utilize magnetic components to detect the same displacements or rotations, and utilize specialized transducers to translate the magnetic effects into electrical signals. Finally, it is also possible to utilize sophisticated gyroscopic arrangements which more accurately reflect the rotation or, more correctly yaw, of the listener's head with respect to predetermined positions. A synchro-digital or synchro-analog converter may be utilized.

The resulting electrical signals may be applied in a wide variety of ways to control the electrical acoustical transfer network. for example, the turning of the head may be translated into voltage, currents, electrical resistance, capacitance, inductance, or other information carrying space-time relationships. The function of the electro-acoustical transfer network is to then translate this information into relative volumes and tones for each particular earphone of the headset, on the basis of the predetermined acoustical environment and the characteristic electro-acoustical transfer function of the particular headphone being used. The present invention utilizes Fourier transformed signals in this electrical acoustical network to perform these tasks.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
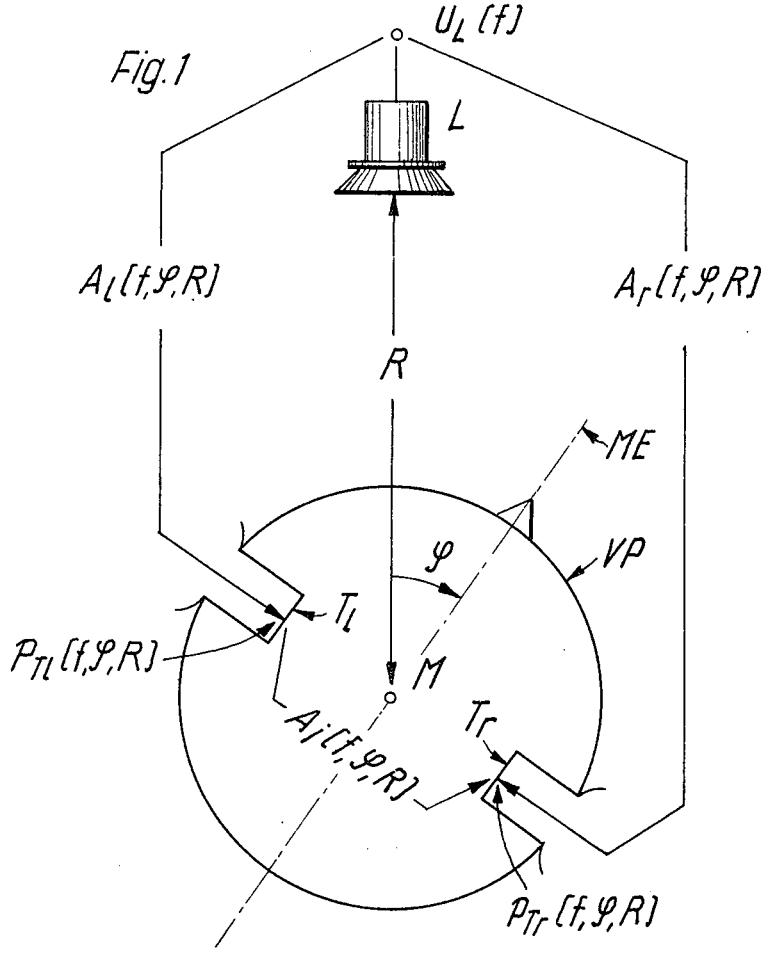
FIG. 1 depicts in a very simplified and highly schematic manner the arrangement between an external acoustical loudspeaker and the head of a listener.

FIG. 1 depicts in a very simplified and highly schematic manner the head of the listener VP, his left and right eardrums $T_l$ and $T_r$, respectively, the center point of the head M, and a plane ME through the center point M and equidistant from the two eardrums $T_l$, $T_r$. A loudspeaker L is located at a distance R from the center point of the head M. The head is assumed to be turned on its axis M relative to the loudspeaker L by an angle $\phi$. Also respresented is the electrical signal voltage $U_L$ (f) which is applied to the input of the acoustical network. According to the invention, it is advantageous to establish a close correspondence between the Fourier transform of the signals impinging upon the eardrums when the sound source is an earphone set, and the Fourier transform of the signals impinging upon the eardrums when the sound source is a loudspeaker, such as represented in FIG. 1. The electrical signal voltage is $u_L(t)$, whose Fourier transform is $U_L(f)$ as represented in FIG. 1. The Fourier transform of the pressure functions impinging upon the listener's eardrums are represented by $P_{Tr}(f,\phi,R)$ and $P_{Tl}(f,\phi,R)$, for the right and left ears, respectively. The electro-acoustical transfer functions $A_l$, $A_r$, for the left and right ears respectively, are defined by:

$$A_l(f,\phi,R) = \frac{P_{Tl}(f,\phi,R)}{U_L(f)} = |A_l(f,\phi,R)| \cdot e^{-j\theta_l(f,\phi,R)}$$

$$A_r(f,\phi,R) = \frac{P_{Tr}(f,\phi,R)}{U_L(f)} = |A_r(f,\phi,R)| \cdot e^{-j\theta_r(f,\phi,R)}$$

This tranfer function is equal to the ratio of the Fourier transforms of the acoustical pressure on the eardrum of the listener to the Fourier transform of the electrical signal voltage applied to the loudspeaker. These transfer functions may be empirically determined both in magnitude and phase through the use of microphones or transducers inserted into the ear of the listener, associated with equipment for measuring the amplitude and phase of the resultant signals. These electro-acoustical transfer functions are monaural.

The biaural electro-acoustical transfer factor $A_i(f,\phi,R)$ is given by the ratio $$A_i(f,\phi,R) = \frac{P_{Tr}(f,\phi,R)}{P_{Tl}(f,\phi,R)} = |A_i(f,\phi,R)| \cdot e^{-j\theta_i(f,\phi,R)}$$

the angles $\theta_l(f,\phi,R)$, $\theta_r(f,\phi,R)$ and $\theta_i(f,\phi,R)$, representing the phase angles of the respective electro-acoustical functions. The transfer functions in question will exhibit frequency dependence not only with respect to magnitude but also with respect to phase. It is therefore advantageous to determine the frequency dependence of the phase shifts associated with the transfer functions. It is not necessary to measure the phase shifts directly. In particular, we only consider the derivative of the phase shift, that is, the group delay time. The group delay times for each of the phase factors are given by the following:

$$\tau_{gl}(f,\phi,R) = \frac{1}{2\pi} \cdot \frac{\delta}{\delta f}\theta_l(f,\phi,R)$$

$$\tau_{gr}(f,\phi,R) = \frac{1}{2\pi} \cdot \frac{\delta}{\delta f}\theta_r(f,\phi,R)$$

$$\tau_{gi}(f,\phi,R) = \frac{1}{2\pi} \cdot \frac{\delta}{\delta f}\theta_i(f,\phi,R)$$

Figure 2:
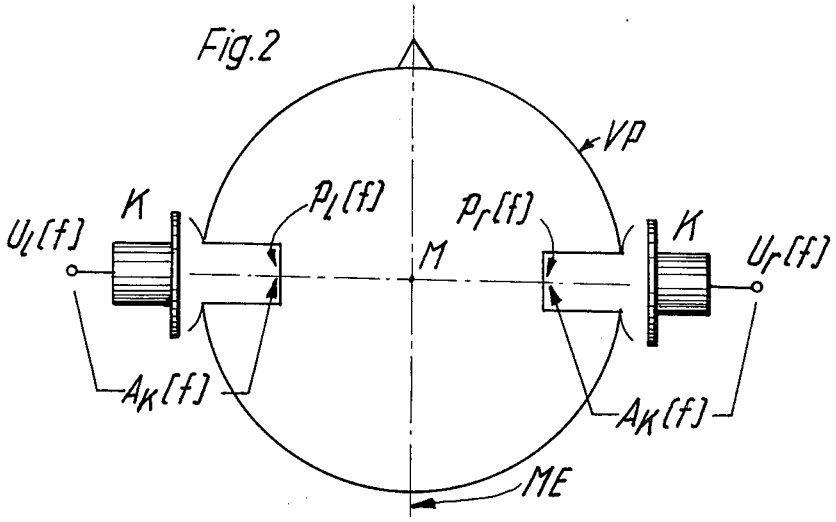
FIG. 2 is an enlarged schematic diagram of the head of the listener, clarifying the meaning of the electro-acoustical transfer functions.

FIG. 2 is a very simplified and highly schematic representation of the head of a listener VP. Also as shown in FIG. 1, the center point of the head M and the plane ME through the point M are represented. Earphones K are represented with the electrical signal Fourier transforms $U_l(f)$ and $U_r(f)$, Fourier transforms of pressure $p_l(f)$ and $p_r(f)$, and electrical electro-acoustical transfer function $A_K(f)$. The electro-acoustical transfer functions are again represented:

$$\frac{P_l(f)}{U_l(f)} = A_K(f)$$

$$\frac{P_r(f)}{U_r(f)} = A_K(f)$$

These relations reflect the geometry of the auditory canal and the impedance of the eardrums.

Figure 3:
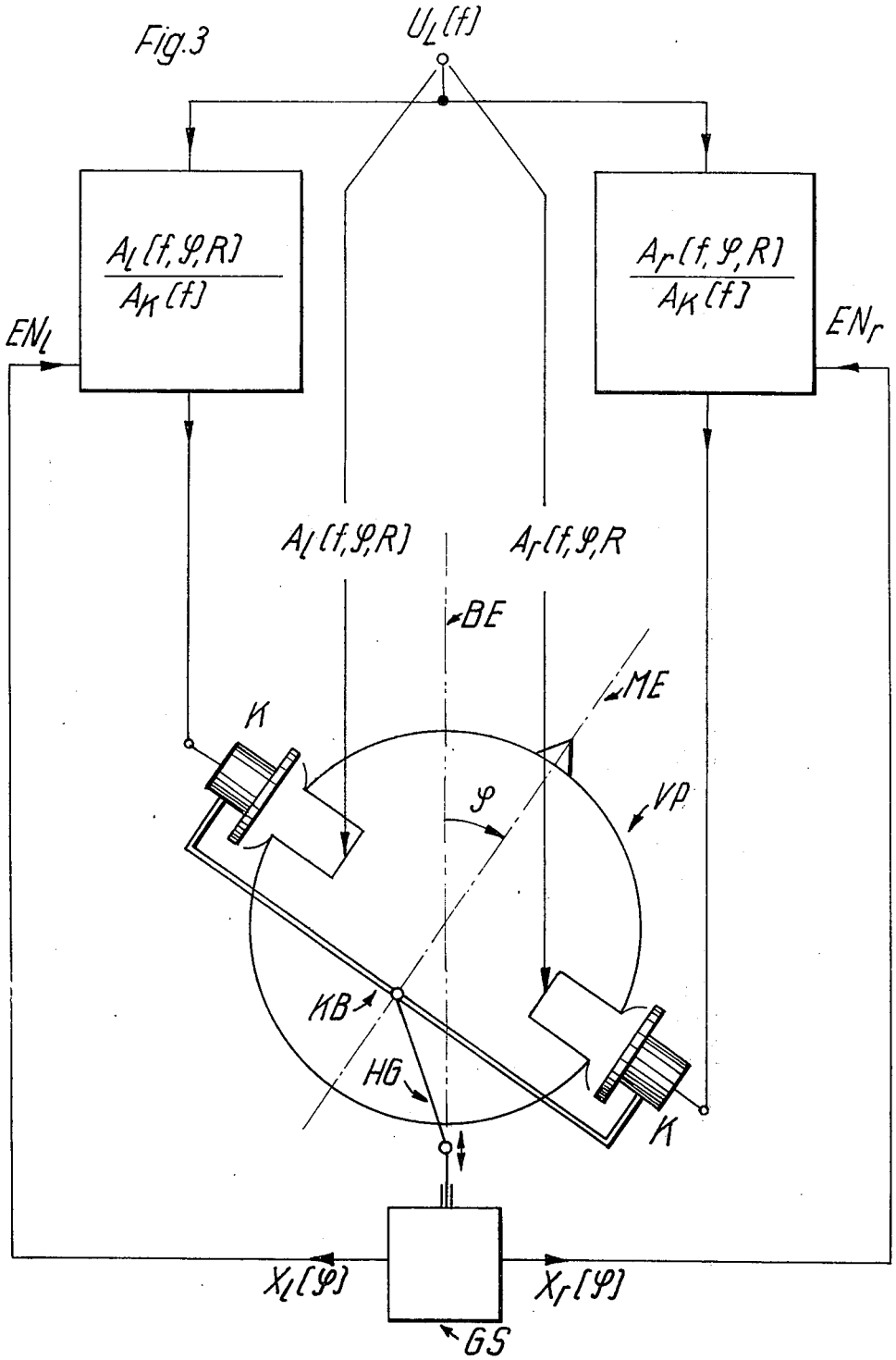
FIG. 3 is a simplified block diagram of the arrangement for controlling the electro-acoustical transfer functions to the ears of the listener on the basis of the change in relative positions of the listener's head.

If one wishes to represent the acoustical sound of a loudspeaker by means of headphones, one has an arrangement according to the present invention as depicted in FIG. 3. The head of the person VP when at rest lies along the plane BE, and may be turned to a position to the left or right, as represented by the plane ME, each plane passing through the center point of the head. The earphones are attached to a headband KB which is in turn attached to a lever HG in a pivotable manner so as to reflect the yaw of the head relative to a stationary control system GS. The control linkage of the lever HG to the unit GS may be affected by means of a thrusting movement of a corresponding shaft which is converted into electrical control signals. The control signals associated with the left and right earphones, respectively are designated $X_l$, and $X_r$. These control signals are applied to the equalizing network $EN_l$ and $EN_r$, as designated in FIG. 3, the equalizing circuits serve to modify the electro-acoustical transfer functions $A_l$ and $A_r$ in accordance with the change in the positions of the listener's head, thereby giving the listener the more realistic effect of listening as if the loudspeaker was placed in front of him, such as the situation in FIG. 1.

The technique of measuring the electro-acoustical transfer factors $A_l$, $A_r$, $A_i$ and $A_K$ are already well known. The measurement may take place with probe tube microphones, placed in the location of the auditory canal of the listener. The realization of the controlling device and the equalizing network are also well known in the art.

Figure 4:
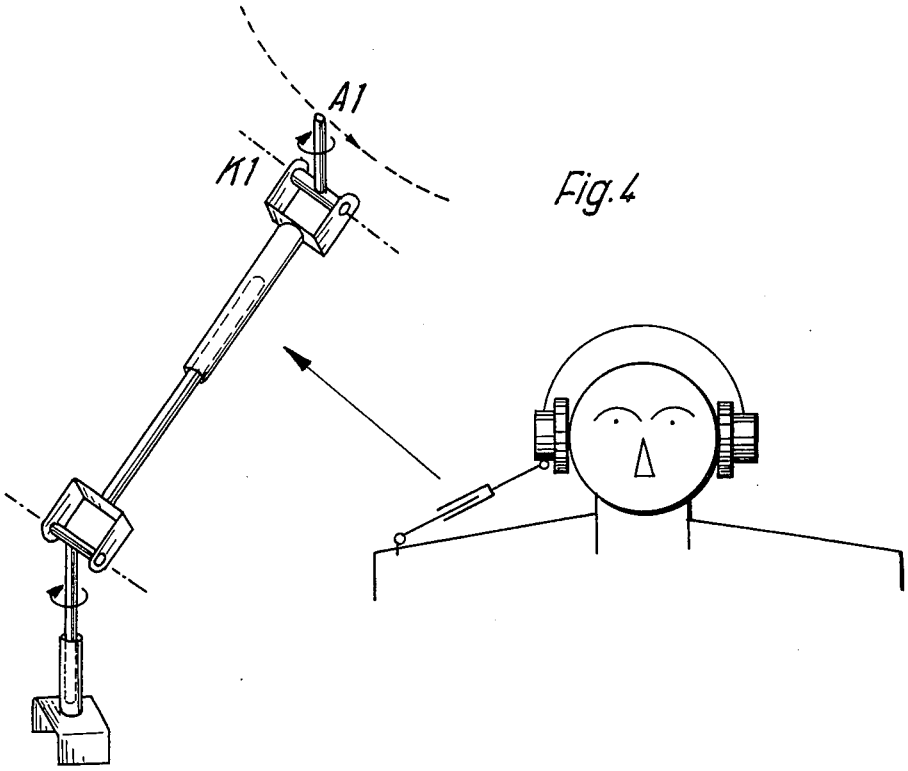
FIG. 4 illustrates the control arrangement utilizing a mechanical lever system, utilizing two telescoping shafts, with one swiveling or rotating member connected to the headphone system, and another rotating and swiveling member connected at the shoulder of the listener, connected by a clip to the listener's clothing.
Figure 5:
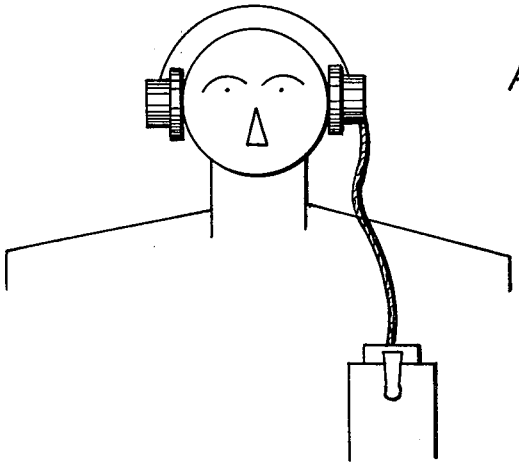
FIG. 5 shows a flexible shaft connecting the headphones to the control circuit clip to a portion of the listener's clothing.
Figure 6:
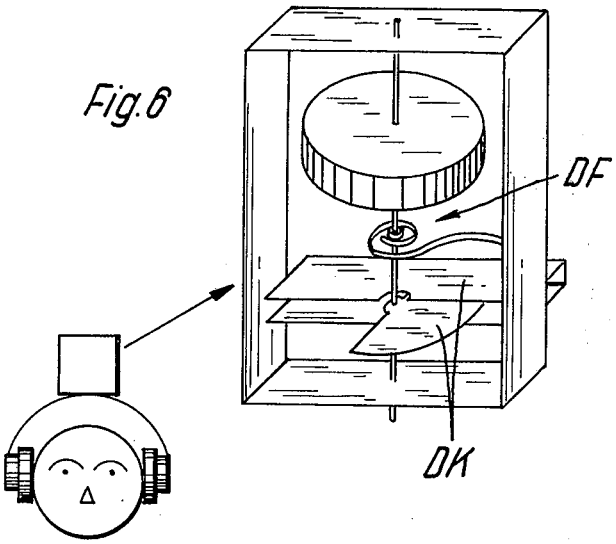
FIG. 6 illustrates a control mechanism consisting of a spiral spring and an axially rotatable mass mounted in a housing mounted on the headphones.
Figure 7:
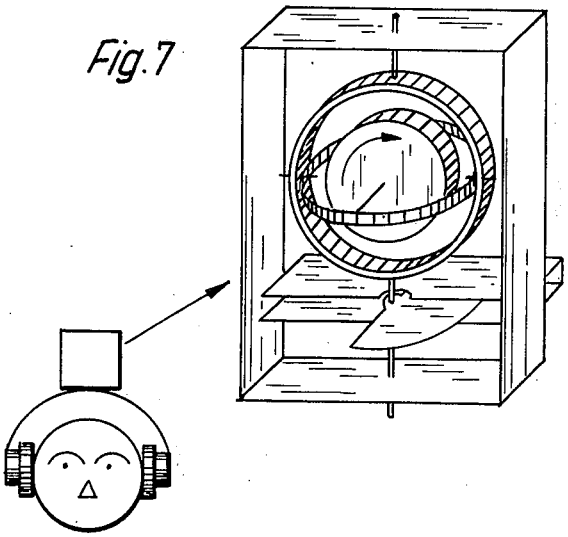
FIG. 7 shows a gyroscope control mechanism mounted on the headphone.

FIG. 4 illustrates the control arrangement utilizing a mechanical lever system, utilizing two telescoping shafts, with one swiveling or rotating member connected to the headphone system, and another rotating and swiveling member connected at the shoulder of the listener, connected by a clip to the listener's clothing. FIG. 5 shows a flexible shaft connecting the headphones to the control circuit clip to a portion of the listener's clothing. FIG. 6 illustrates a control mechanicm consisting of a spiral spring and an axially rotatable mass mounted in a housing mounted on the headphones. FIG. 7 shows a gyroscope control mechanism mounted on the headphone.

Figure 8:
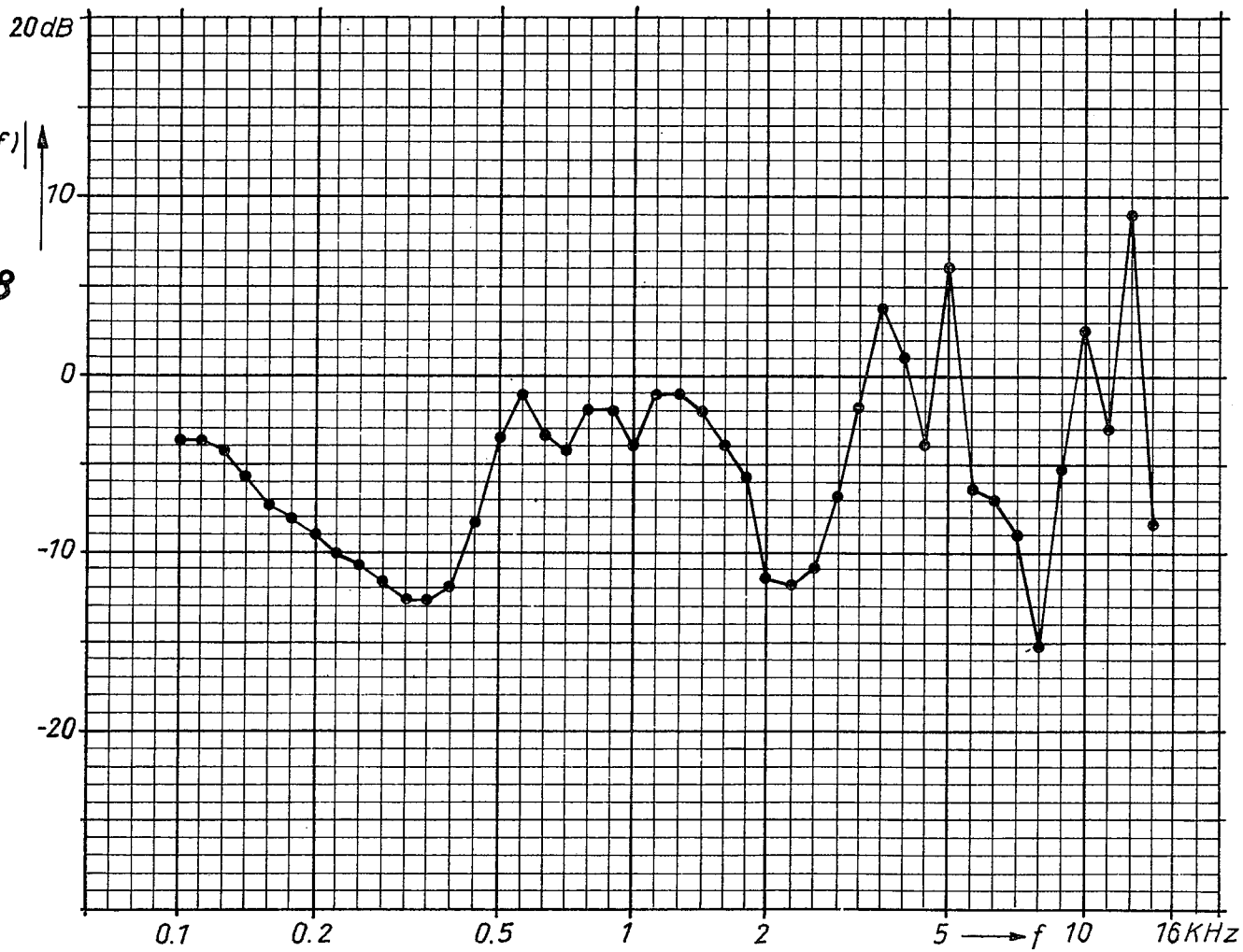
FIGS. 8, 9 and 10 are graphs of the electro-acoustical function as a function of frequency for phase angles of 0°, 30° and −30°, respectively.
Figure 9:
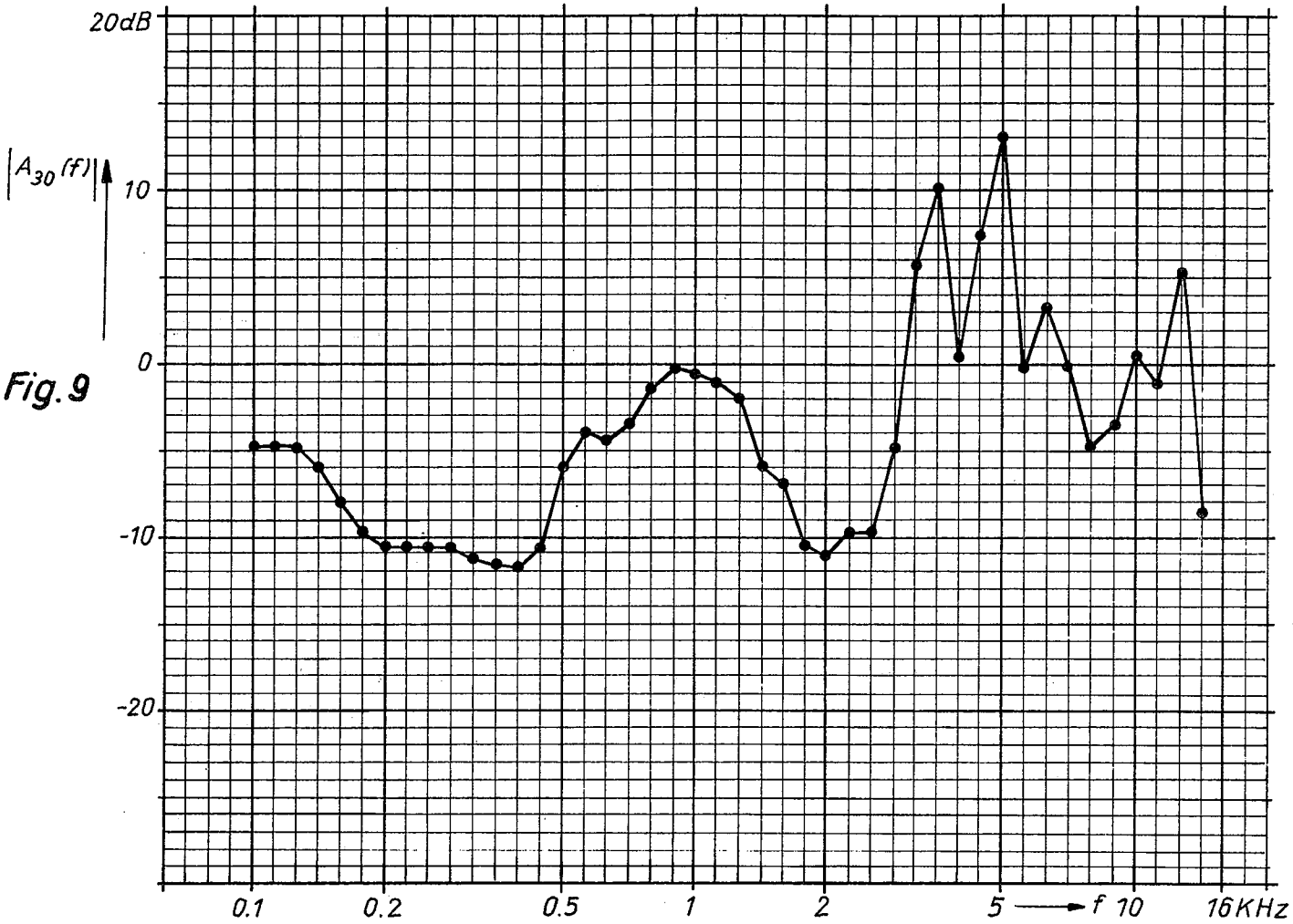
Figure 10:
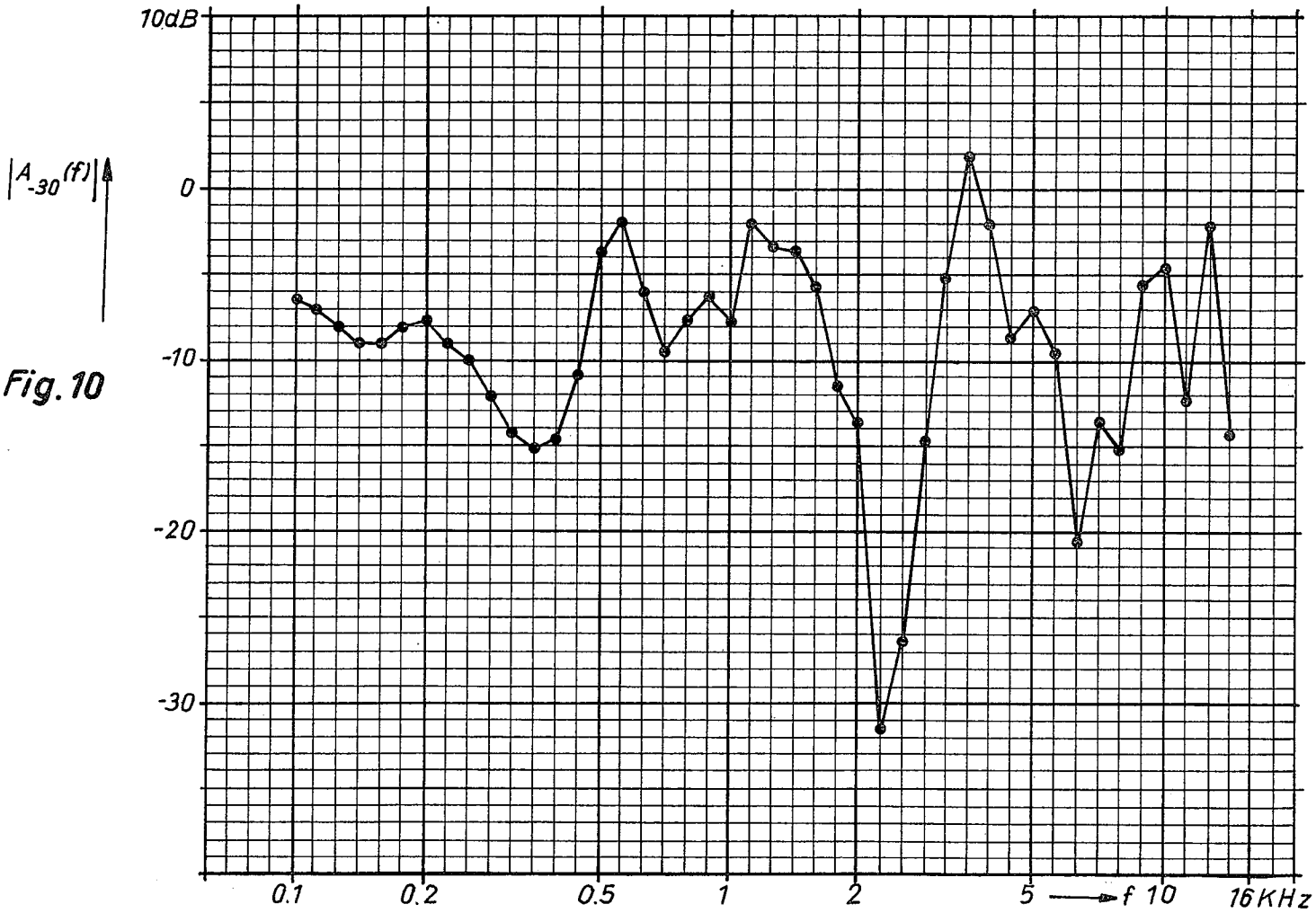

FIGS. 8, 9 and 10 are graphs of the electrical acoustic transfer function at various phase angles. Assume that in an anechoic chamber the following transfer functions are measured by a probe tube microphone, in a predetermined acoustic environment:

$$A_l(f,\phi=0°, R=3m) = A_r(f,\phi=0°, R=3m)$$

$$A_l(f,\phi=30°, R=3m) = A_r(f,\phi=-30°, R=3m)$$

$$A_l(f,\phi=-30°, R=3m) = A_r(f,\phi=+30°, R=3m)$$

and $A_K(f)$.

According to the present invention the following values are calculated from the results of the measurements:

(a) absolute value of the transfer function $$A_0(f) = \frac{A_l(f,\phi=0°,R=3m)}{A_K(f)},$$

shown in FIG. 8.

(b) absolute value of the transfer function $$A_{30}(f) = \frac{A_l(f,\phi=30°,R=3m)}{A_K(f)},$$

shown in FIG. 9.

(c) absolute value of the transfer function $$A_{-30}(f) = \frac{A_l(f,\phi=-30°,R=3m)}{A_K(f)}$$

shown in FIG. 10.

(d) group delay $$\tau g_{0K}(f) = \frac{1}{2\pi}\left[\frac{\delta\theta_l(f,\phi=0°,R=3m)}{\delta f} - \frac{\delta\theta_K(f)}{\delta f}\right]$$

(e) group delay $$\tau g_{30K}(f) = \frac{1}{2\pi}\left[\frac{\delta\theta_l(f,\phi=30°,R=3m)}{\delta f} - \frac{\delta\theta_K(f)}{\delta f}\right]$$

(f) group delay $$\tau g_{-30K}(f) = \frac{1}{2\pi}\left[\frac{\delta\theta_l(f,\phi=-30°,R=3m)}{\delta f} - \frac{\delta\theta_K(f)}{\delta f}\right]$$

(g) group delay $$\tau gi(f,\phi=30°,R=3m) = \tau g{-}30K^{(f)} - \tau\, g30K^{(f)}$$

The symbol $\theta$ indicates the phase angle of the inverted transfer function.

Figure 11:
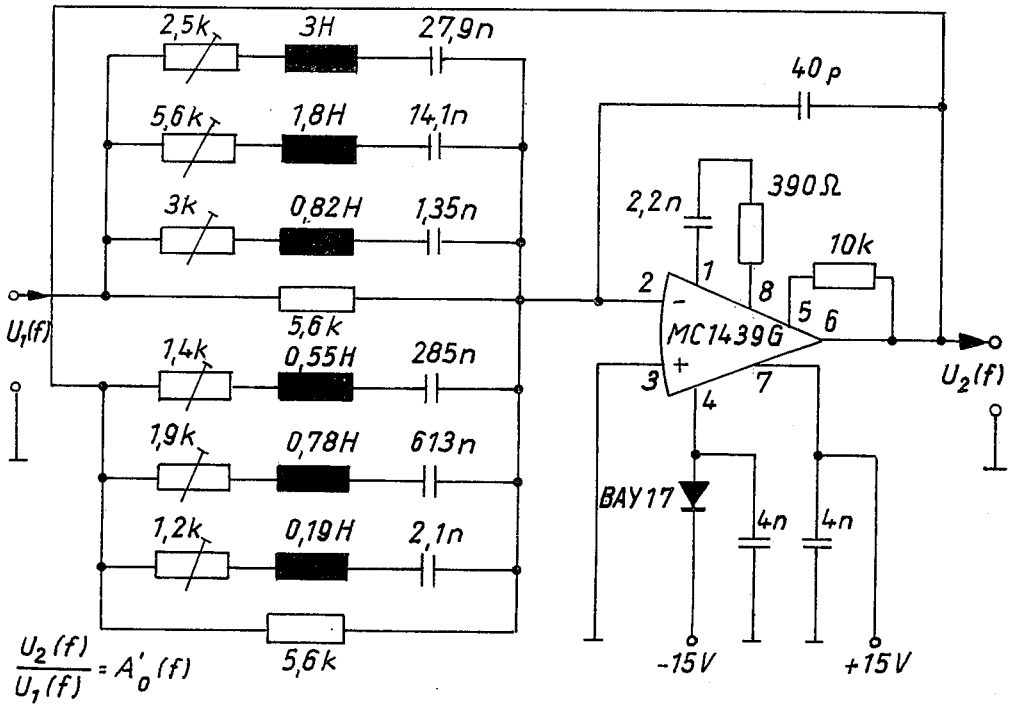
FIGS. 11, 12 and 13 are electrical networks designed according to the principles of the present invention to realize the absolute value characteristics of the above electro-acoustical transfer functions in FIGS. 8, 9 and 10, respectively.
Figure 12:
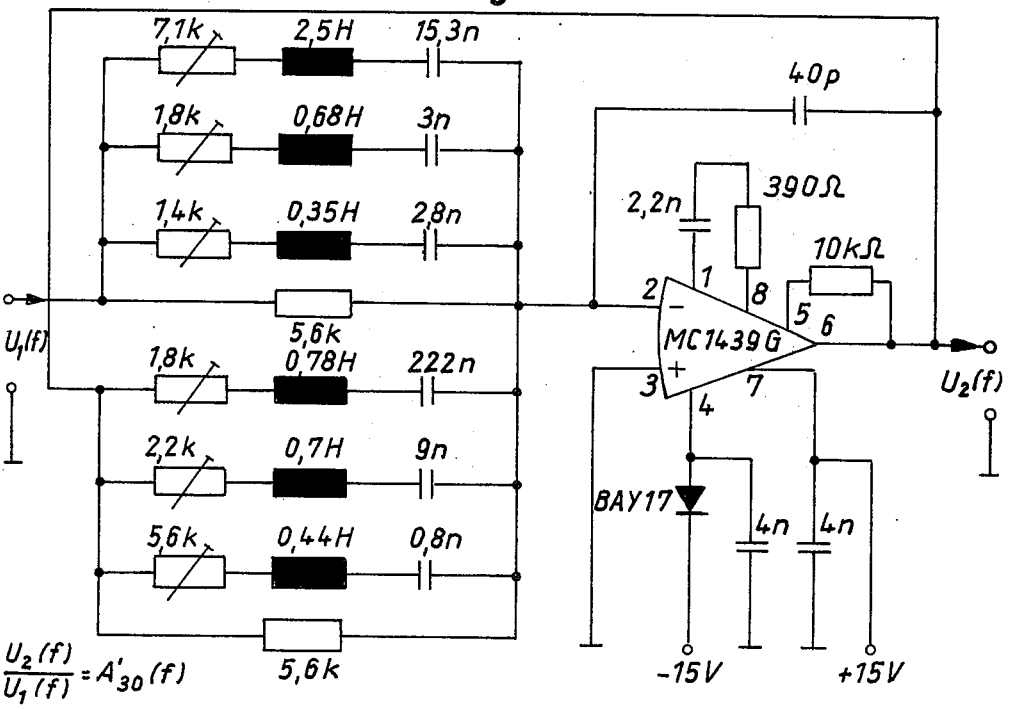
Figure 13:
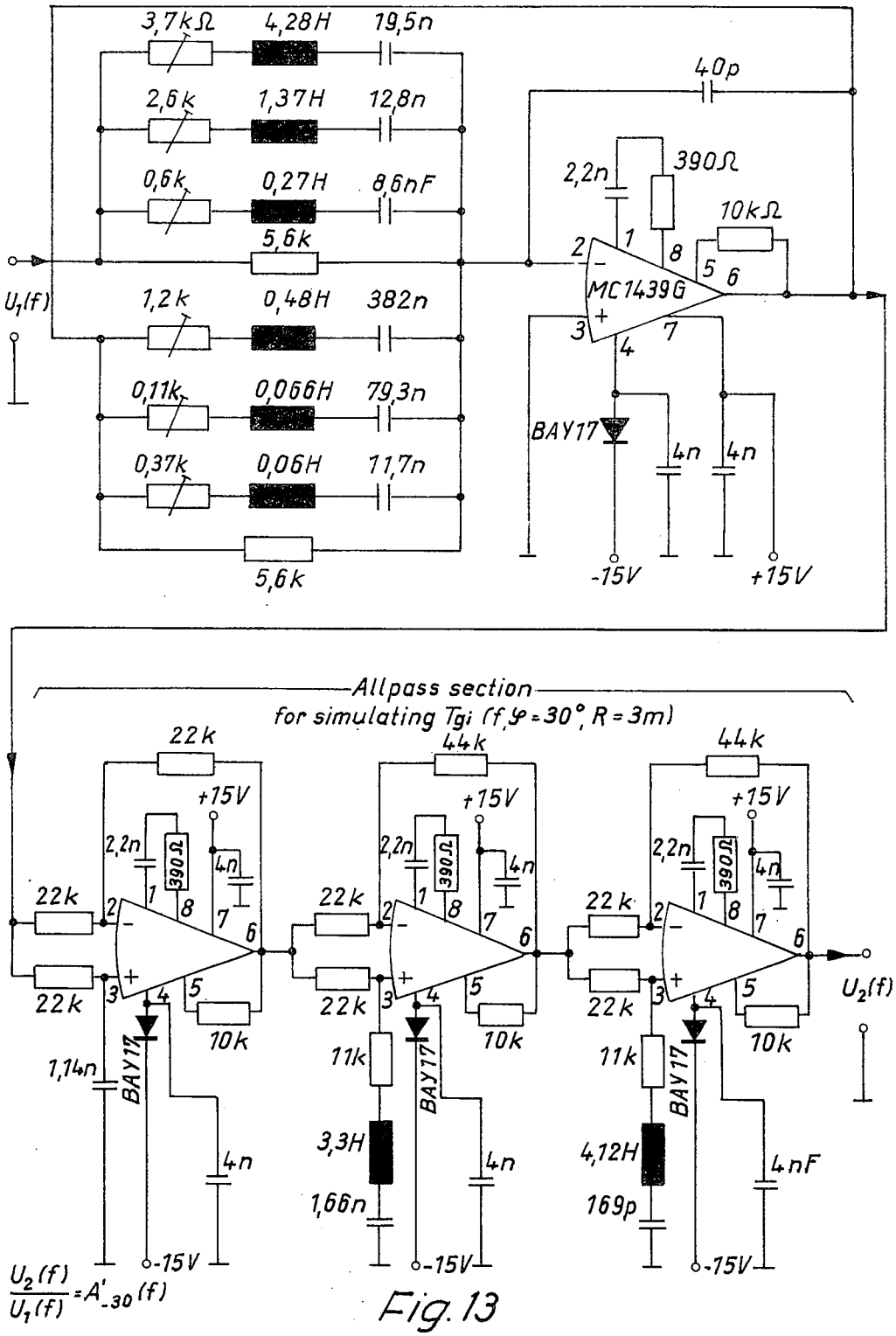

It is now possible to realize electrical networks which approximately determine the transfer functions, $A_0(f)$, $A_{30}(f)$, $A_{-30}(f)$ respectively. These networks are shown in FIGS. 11, 12 and 13 for the electrical acoustical transfer functions $A_0(f)$, $A_{30}(f)$, respectively.

Figure 14:
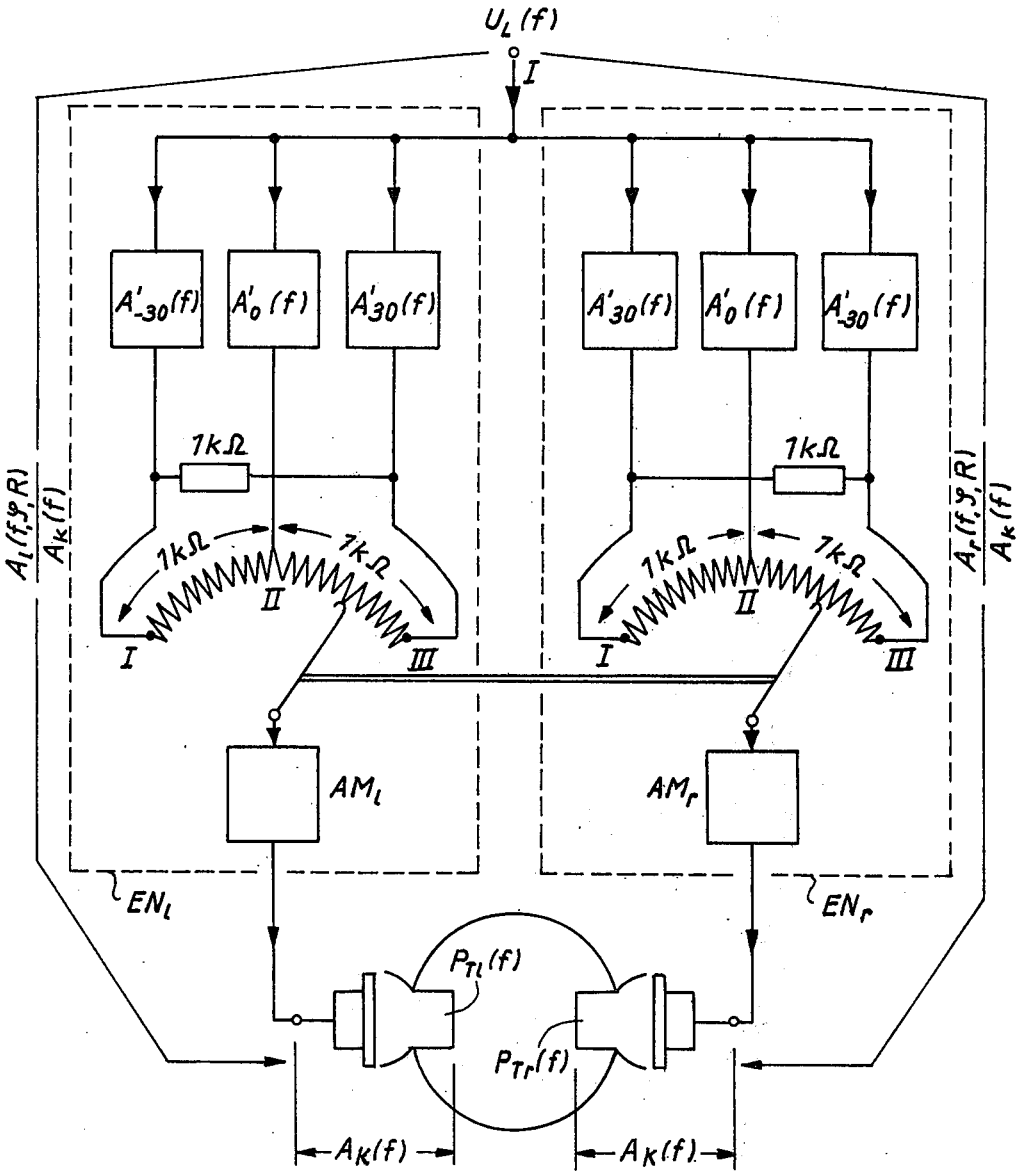
FIG. 14 is a schematic diagram of an arrangement for employing the electrical networks of FIGS. 11, 12 and 13 in the arrangement as taught by the present invention.

FIG. 14 depicts schematically an arrangement which realizes the two networks $EN_l$ and $EN_r$, comprising:

a. six electrical networks characterized by the corresponding transfer functions and utilizing operational amplifiers. One particular operation amplifier used in the present invention is Motorola's MC1439G.

b. a double potentiometer or trimmer T whose rotary wiper shaft coincides with the shaft Al, as shown in FIG. 4, or is otherwise operatively connected to the shaft Al. The idea of the present invention is that the wipers of the potentiometers or trimmer T move toward position I or II respectively as the listener wearing the headphone according to the present invention turns his head to the left or right side respectively.

c. Two amplifiers $AM_l$ and $AM_r$ both distortion free and having an amplification factor $v = -1$. The operation of the arrangement is as follows: If the listener wearing the head phones looks straight ahead, the wipers of the potentiometer T are in the position II. In this case the transfer function of the system "input I-left eardrum" and "input I-right eardrum" is $A_0'(f)\cdot A_K(f) \approx A_l(f,\phi=0°, R=3m)$. If the test listener turns his head, for instance 30° to the right side, the wipers of the potentiometer T would be displaced to the position III. Now the transfer function of the system "input I-left eardrum" is $A_{30}'(f)\cdot A_K(f) \approx A_l(f,\phi=30°,R=3m)$ and the transfer function of the system "input I-right eardrum" is $A_{-30}'(f)\cdot A_K(f) \approx A_l(f,\phi=-30°,R=3m)$. Similarly, turning the head 30° to the left side brings the wipers of the potentiometer T to the position I. In this case the resulting transfer functions are for the system "input I-left eardrum" $A'_{-30}(f)\cdot A_K(f) \approx A_l(f,\phi=-30°,R=3m)$ and for the system "input I-right eardrum" $A'_{30}(f)\cdot A_K(f) \approx A_l(f,\phi=30°,R=3m)$. The intermediate head positions result in intermediate positions of the wiper of the potentiometer. Therefore a synchronized and continuous changeover from one of the above introduced transfer functions to the other transfer function is possible, i.e., the transfer characteristics of the equalizing network $EN_l$ and $EN_r$ can be controlled by the head movements of the listener directly and in a continuous fashion.

It is possible to utilize a number of different equalizer arrangements for practicing the present invention. Reference is made to one particular commercial equalizer, the DLZ-1, manufactured by Wandel and Goltermann of Reutlingen, Germany, as attenuation and delay equalizer capable of performing the desired functions within the absolute value characteristics and the group delay characteristics as measured according to the present invention.

Figure 15:
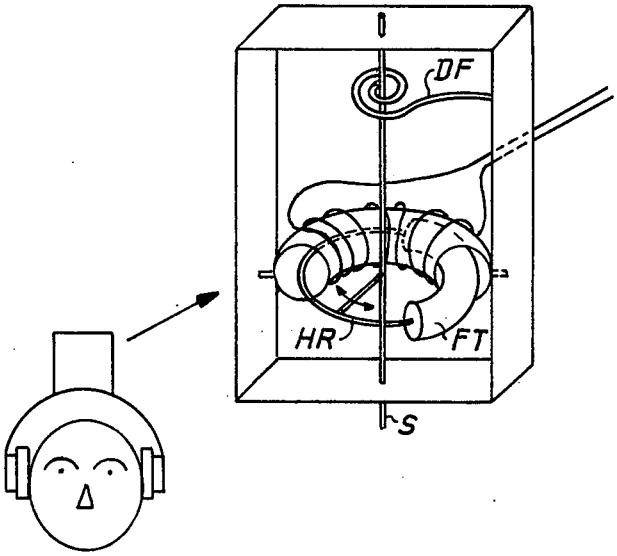
FIG. 15 is a mechanical and magnetic arrangement for determining the relative position of the head of the listener.

FIG. 15 illustrates a mechanical and magnetic system for controlling the transfer function of the equalizing network $EN_l$ and $EN_r$. The spring-mass system operates in the following manner: A toroid FT consisting of ferromagnetic material is fixed to the shaft S by means of a holding ring HR. By means of a torsion spring DF the toroid is held in a rest or zero position. If the listener turns his head, for instance to the right side, the toroid will turn in a specific direction around a coil of wire which surrounds the ferromagnet. The change in position of the moveable ferromagnet toroid with respect to the fixed coil of wire surrounding the ferromagnet will induce an electrical current in the coils of wire which may be sensed by a control device (not shown). The arrangement shown in FIG. 15, a mechanical and magnetic arrangement for producing a controlling electric current, can thereby be used to control the impedances, and thereby the resonant frequencies, of a band filter, or, in general, the frequency of an oscillator associated with the electrical networks. The transfer function of the equalizing network $EN_l$ and $EN_r$ can thereby be directly and continuously modified.

It will be understood that each of the elements described above, or two or more together, may also find a useful application in other types of acoustical output control arrangements differing from the types described above.

While the invention has been illustrated and described as embodied in a method and arrangement for controlling acoustical output of earphones, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptions should and are intended to be comprehended within the meaning and range of equivalence of the following claims.

What is claimed as new and desired to be protected by Letters Patent is set forth in the appended claims:

1. A sound reproduction method, comprising, in combination, the steps of applying an audio signal to the audio-signal input of a headphone set to produce in the ears of the wearer of the headphone set corresponding audible sound waves; continually detecting changes in the orientation of the head of the wearer of the headphone set; and in dependence upon the detected changes in the orientation of the head of the wearer modifying said audio signal to effect changes in the audible sound waves produced in the ears of the wearer simulating the changes which would occur if the wearer of the headphone set were actually listening to an external stationary sound source, whereby to avoid the psychological impression of an orchestra, or the like, moving as a whole when the wearer of the headphone set moves his head.

2. The method defined in claim 1, wherein said step of modifying said audio signal comprises modifying the spectral composition of said audio signal in dependence upon the detected changes in the orientation of the head of the wearer of the headphone set.

3. The method defined in claim 1, wherein said step of modifying said audio signal comprises passing said audio signal through a network having an adjustable complex transfer function and adjusting thhe complex transfer function in dependence upon the detected changes in the orientation of the head of the wearer of the headphone set.

4. The method defined in claim 1, the headphone set being a multi-channel headphone set and the audio signal being a multi-component signal, and wherein said step of modifying the audio signal comprises differently modifying the respective spectral compositions of the components of the audio signal in dependence upon the detected changes in the orientation of the head of the wearer.

5. The method defined in claim 1, the headphone set being a multi-channel headphone set and the audio signal being a multi-component signal, and wherein said step of modifying the audio signal comprises separately passing the components of the audio signal through respective networks having respective adjustable complex transfer functions and differently adjusting the complex transfer functions of the respective networks in dependence upon the detected changes in the orientation of the head of the wearer of the headphone set.

6. The method defined in claim 1, the headphone set being a multi-channel headphone set and the audio signal being a multi-component signal, and wherein said step of modifying said audio signal comprises differently modifying the components of the audio signal in dependence upon the detected changes in the orientation of the head of the wearer.

7. The method defined in claim 6, wherein said step of modifying said audio signal comprises modifying the spectral composition of said audio signal in dependence upon the detected changes in the orientation of the head of the wearer of the headphone set.

8. The method defined in claim 6, wherein said step of modifying said audio signal comprises passing said audio signal through a network having an adjustable complex transfer function and adjusting the complex transfer function in dependence upon the detected changes in the orientation of the head of the wearer of the headphone set.

9. In a sound reproduction arrangement, in combination, a headphone set having an audio-signal input and operative upon application of an audio signal to said input for producing in the ears of the wearer of the headphone set audible sound waves corresponding to the audio signal; detecting means operative for continually detecting changes in the orientation of the head of the wearer of the headphone set; and compensating means automatically operative in dependence upon the detected changes in the orientation of the head of the wearer for modifying the audio signal to effect changes in the audible sound waves produced in the ears of the wearer simulating the changes which would occur if the wearer of the headphone set were actually listening to an external stationary sound source, whereby to avoid the psychological impression of an orchestra, or the like, moving as a whole when the wearer of the headphone set moves his head.

10. In an arrangement as defined in claim 9, wherein said compensating means comprises means operative for modifying the spectral composition of the audio signal in automatic response to the detection of changes in the orientation of the head of the wearer of the headphone set.

11. In an arrangement as defined in claim 9, wherein said compensating means comprises circuit means operative for receiving and transmitting said audio signal and having an adjustable complex transfer function and adjusting means operative for adjusting the complex transfer function in automatic response to the detected changes in the orientation of the head of the wearer of the headphone set.

12. In an arrangement as defined in claim 9, wherein said detecting means comprises means operative for detecting that components of a change in the orientation of the head of the wearer constituting rotation relative to a predetermined axis.

13. In an arrangement as defined in claim 9, wherein said compensating means comprises a mechanical linkage connected to the headphone set and furthermore connectable to a reference point and operative for providing an indication of the orientation of the head of the wearer.

14. In an arrangement as defined in claim 13, wherein the linkage is connectable to an article of clothing worn by the wearer of the headphone set.

15. In an arrangement as defined in claim 9, wherein said detecting means comprises two components of an electromechanical transducer one of which is mounted for rotation relative to a predetermined axis and relative to the other component of the transducer, and means for producing such relative movement between the components of the electromechanical transducer in automatic response to that component of a change in the orientation of the head of the wearer constituting rotation relative to said axis.

16. In an arrangement as defined in claim 15, wherein the two components of the transducer are plates of a rotary capacitor.

17. In an arrangement as defined in claim 9, wherein said detecting means comprises means operative for detecting changes in the orientation of the head of the wearer in a plurality of directions.

18. In an arrangement as defined in claim 17, wherein said detecting means comprises gyroscopic means operative for indicating changes in the orientation of the head of the wearer in a plurality of directions.

19. In an arrangement as defined in claim 9, wherein said headphone set is a multi-channel headphone set adapted to convert a mult-component audio signal into a corresponding plurality of sets of corresponding audible sound waves, and wherein said compensating means comprises means automatically operative for differently modifying the components of said audio signal in dependence upon the detected changes in the orientation of the head of the wearer.

20. In an arrangement as defined in claim 19, wherein said means for differently modifying the components of said audio signal comprises means for differently modifying the respective spectral compositions of the components of the audio signal in dependence upon the detected changes in the orientation of the head of the wearer.

21. In an arrangement as defined in claim 19, wherein said means for differently modifying the components of said audio signal comprises a plurality of circuit means each operative for receiving and transmitting respective components of the audio signal and each having a respective adjustable complex transfer function and adjusting means operative for adjusting the complex transfer functions in automatic response to the detected changes in the orientation of the head of the wearer of the headphone set.

* * * * *